US007014800B2

(12) United States Patent
Weihrauch

(10) Patent No.: US 7,014,800 B2
(45) Date of Patent: Mar. 21, 2006

(54) METHOD OF PRODUCING BRISTLES

(75) Inventor: Georg Weihrauch, Wald-Michelbach (DE)

(73) Assignee: PEDEX & Co. GmbH, Wald-Michelbach (DE)

( * ) Notice: Subject to any disclaimer, the term of this patent is extended or adjusted under 35 U.S.C. 154(b) by 421 days.

(21) Appl. No.: 10/260,961

(22) Filed: Oct. 1, 2002

(65) Prior Publication Data

US 2003/0044604 A1 Mar. 6, 2003

Related U.S. Application Data

(63) Continuation of application No. PCT/EP01/03466, filed on Mar. 27, 2001.

(30) Foreign Application Priority Data

Apr. 9, 2000 (DE) ..... 100 17 306

(51) Int. Cl.

| | |
|---|---|
| ***A46B 11/00*** | (2006.01) |
| ***D01D 5/253*** | (2006.01) |
| ***D02G 3/36*** | (2006.01) |
| ***D02G 3/44*** | (2006.01) |

(52) U.S. Cl. ..... 264/45.9; 264/103; 264/129; 264/138; 264/151; 264/171.13; 264/173.11; 264/173.12; 264/177.13; 427/2.29; 427/293; 427/421; 427/434.6

(58) Field of Classification Search ..... 264/45.9, 264/103, 129, 138, 151, 171.13, 173.12, 264/177.13, 173.11; 427/2.29, 293, 421, 427/434.6

See application file for complete search history.

(56) References Cited

U.S. PATENT DOCUMENTS

| | | | |
|---|---|---|---|
| 3,785,919 | A | 1/1974 | Hickman |
| 4,010,308 | A | 3/1977 | Wiczer |
| 4,775,585 | A | 10/1988 | Hagiwara et al. |
| 5,313,909 | A | 5/1994 | Tseng et al. |
| 5,678,275 | A | 10/1997 | Derfner |
| 5,836,769 | A | 11/1998 | Spencer |

FOREIGN PATENT DOCUMENTS

| | | | |
|---|---|---|---|
| DE | 34 00 941 | A1 | 10/1984 |
| DE | 195 08 539 | A1 | 9/1996 |
| DE | 195 25 808 | A1 | 1/1997 |
| DE | 195 33 815 | A1 | 3/1997 |
| DE | 195 45 644 | C1 | 4/1997 |
| DE | 197 48 733 | A1 | 5/1999 |
| DE | 692 27 777 | T2 | 5/1999 |
| DE | 198 18 345 | A1 | 10/1999 |
| DE | 198 29 943 | A1 | 1/2000 |
| EP | 0 450 210 | A1 | 10/1991 |
| GB | 2 323 026 | A | 9/1998 |
| WO | WO 97 25 902 | A1 | 7/1997 |
| WO | WO 98 24 341 | A1 | 6/1998 |

*Primary Examiner*—Leo B. Tentoni
(74) *Attorney, Agent, or Firm*—Paul Vincent

(57) ABSTRACT

Bristles for applying media are produced in that a filament, which can be cut into bristles, is extruded with a core which also determines the mechanical properties of the bristle. Cavities are formed at a separation from the center of the core and open towards the circumference of the filament which can be filled with medium from the outside, wherein the circumferential openings of the cavities are formed such that the medium is discharged only when the bristle is appropriately used. The cavities may also have a larger opening width and be covered by a layer or jacket. A bristle and brushes having such bristles produced in accordance with this method are also described.

31 Claims, 7 Drawing Sheets

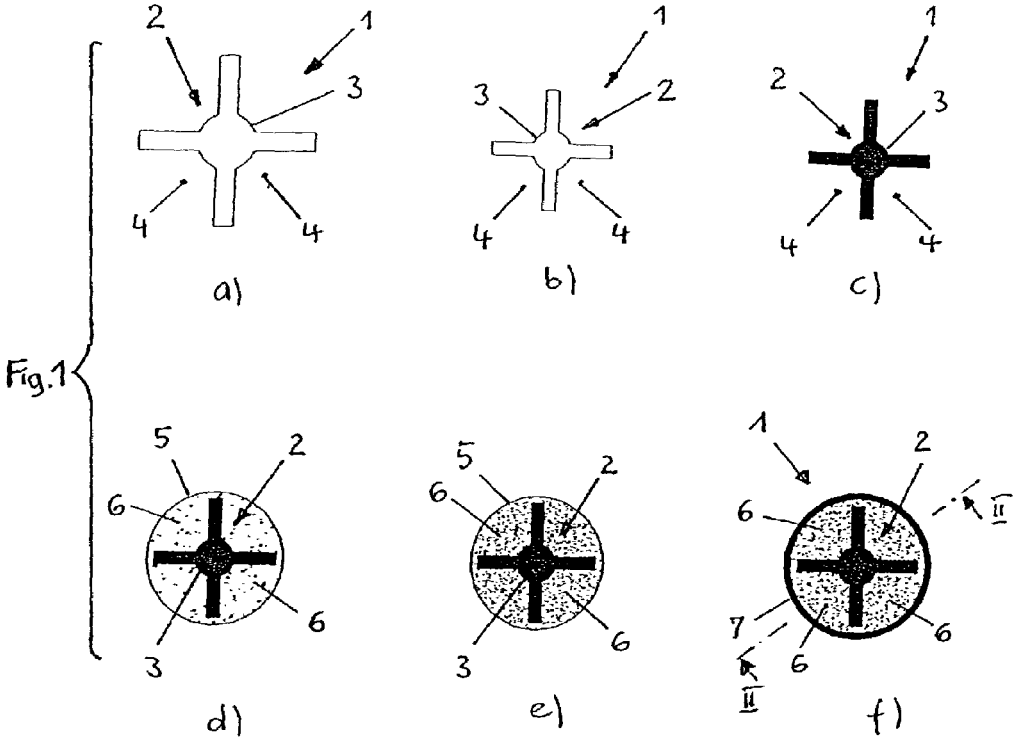
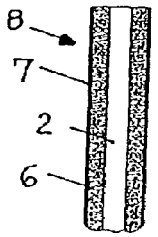
Fig.2
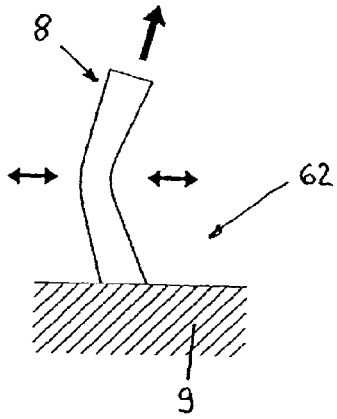
Fig.3
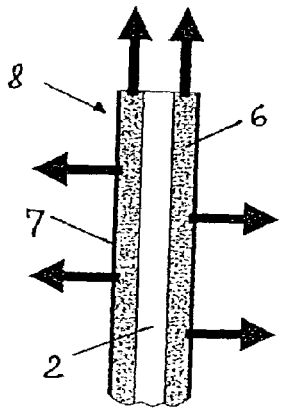
Fig.4

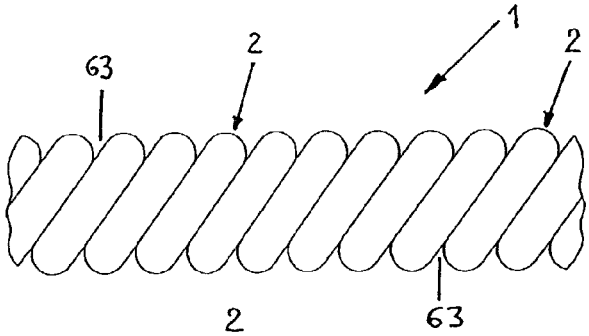
Fig.12
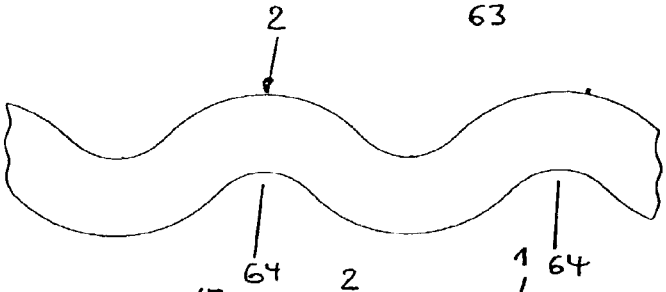
Fig.13
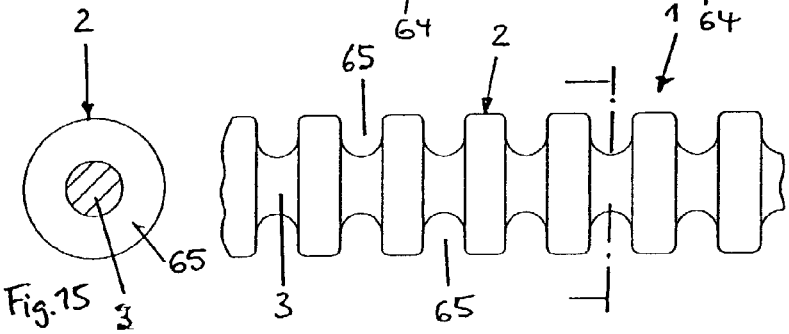
Fig.14
Fig.15
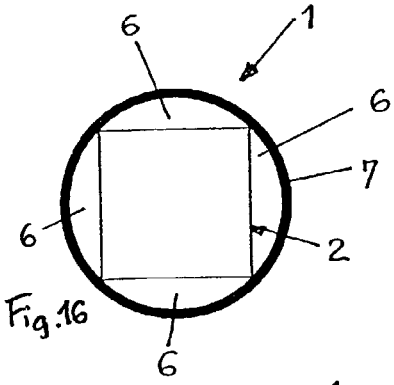
Fig.16
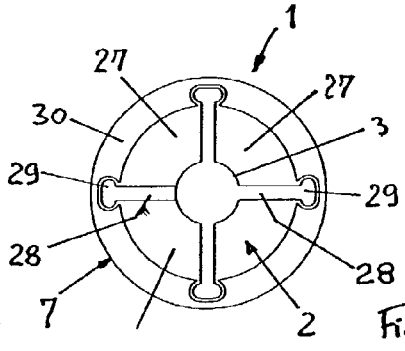
Fig.19
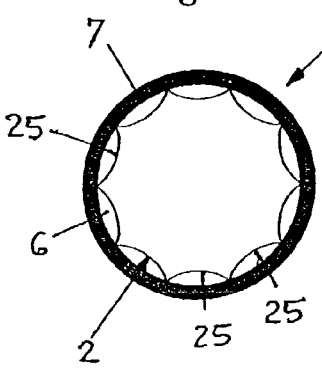
Fig.17
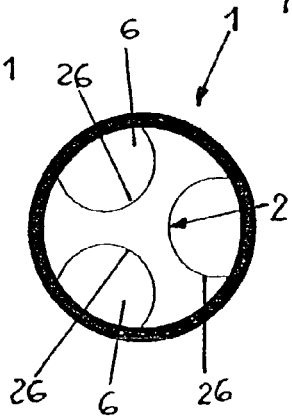
Fig.18
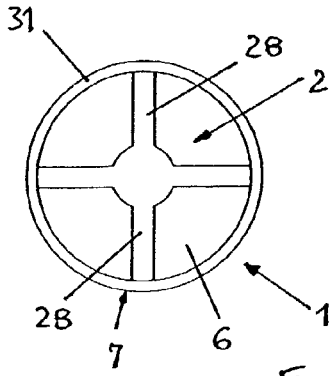
Fig.20

METHOD OF PRODUCING BRISTLES

This is a Continuation of PCT/EP01/03466 filed Mar. 27, 2001 and claims Paris Convention priority of DE 100 17 306.3 filed Apr. 9, 2000 the entire disclosure of which are hereby incorporated by reference.

BACKGROUND OF THE INVENTION

The invention concerns a method of producing bristles for applying media through extrusion of a filament which can be cut into bristles and provided with cavities for receiving the medium and from which the medium is discharged during proper use of the bristles, as well as a bristle and brushes comprising such bristles produced in accordance with this method.

Brushes comprising bristles for applying liquid, viscous or powdery media are used mainly for body, hair and mouth care but also in the household and for technical applications. The invention is described below mainly in connection with tooth brushes, one of the main fields of application.

Tooth brushes are known which highlight film on the teeth through application of a suitable indicating color to allow the user of the tooth brush to increase brushing of such indicated tooth locations (DE 195 45 644). Towards this end, the brushes are coated with the indicating color or with microcapsules containing the color and the coating is optionally sealed. A hollow brush with inserted indicating medium is also described in this connection. This document does not explain in detail how these hollow brushes are filled. It is further known (CA 549 168) to jacket the brushes of a single-use tooth brush with a tooth care medium. Bristles are also known (U.S. Pat. No. 5,678,275) whose circumference is provided with irregularly shaped grooves. They do not accommodate media but are supposed to accept soilage particles to remove them from the mouth during brushing of the teeth.

It is furthermore known (WO 98/24341) to accommodate therapeutically effective or other media having dental medical effects in a hollow brush which are released at the free open end of the brush during use. The hollow brush is optionally reinforced by radial walls such that it comprises three or four chambers with parallel axes. The desired media are introduced in liquid form. Towards this end, filaments having the cross-sectional shape of the finished bristles are extruded and several filaments are combined into multi-veined strands having a diameter up to 5.5 cm and a length up to 1.2 m. One end of the strand is dipped into the liquid medium and suction is applied to the opposite open ends of the filaments. Since a high suction pressure is required due to the capillary cavities and the large strand length and since collapsing of the walls due to the elasticity of a suitable plastic must be prevented, the wall must be quite thick and complete filling of the hollow bristles is not possible. Viscous or dispersed media cannot be introduced into the capillary cavities due to the high pressure drop. During use of the bristle, the medium is only discharged via the open end of the bristles and is therefore fully undefined and incomplete.

U.S. Pat. No. 4,775,585 describes a polymer article e.g. in the form of a fiber having a solid cross section. A medium is introduced into portions of the cross section which should be dispensed when the fiber is in use. The portions of the fiber containing the medium can be circular sectors distributed about the periphery or could form an outer ring of the cross section. This configuration does not lead to defined release of the medium.

U.S. Pat. No. 4,010,308 discloses a fiber having a porous coating, hollow portions of which accommodate a medium. The hollow cavities result in relatively rapid and undefined release of the medium. An electrically conducting fiber can be created by using of an electrolyte as the medium and the outer surface of the fiber can be provided with an insulating, impermeable shellac coating. No medium release is therefore envisioned.

It is the underlying purpose of the invention to propose a method for economical introduction of media of arbitrary consistency and effect into a bristle and for discharge thereof in a desired dosage during the useful life of the bristle.

SUMMARY OF THE INVENTION

This object is achieved in accordance with the invention by a method according to the independent method claims. In a first embodiment of the invention, the filament is extruded having a core which also determines the mechanical properties of the bristle, with cavities being formed at a separation from the center of the core which open towards the circumference of the filament via a gap formed at the circumference, wherein the cavities are filled with medium from the outside, the gaps being formed such that they are closed in an unloaded state of the bristle and first open in response to pressure generated during proper use of the bristle to release the medium.

In the inventive method, the media is externally introduced into the cavities which are open to the outside, i.e. they must not be suctioned via a pressure drop over a relatively large distance, which would entail corresponding pressure losses. The cavities may therefore be advantageously filled at constant medium density. The consistency of the medium is not important for introduction. It can be liquid, viscous or disperse. Discharge occurs directly through the circumferential openings during use: they are sufficiently narrow to retain the medium and are discharged only during use, e.g. via the forces applied during brushing or through media present at the location of use which interact with the medium in the brush and rinse or dissolve same, i.e. saliva or a tooth care medium for tooth brushes and, in the simplest case, water or moisture for cleaning brushes.

A further advantageous embodiment of the method proposes extrusion of the filament with a core which also determines the mechanical properties of the bristle, with formation of the cavities at a separation from the center of the core, the cavities opening towards the circumference of the filament and being filled with the medium from the outside, wherein the filament is subsequently provided, at least in parts, with a layer which at least partially covers the openings and controls discharge of the medium under normal conditions of brush use. In this method, the shape of the circumferential opening and the opening width are less decisive. The selection of the material of the layer, its thickness and the extent to which the cavities containing the medium are covered can control discharge of the medium over time and in dependence on how long brushes having such bristles are used.

If the cavities are preferably closed by a jacket, the medium can be discharged via the open bristle end or through the openings in the cavities exposed during slow wear of the jacket or also by diffusion through the jacket, wherein the jacket may have a thinner wall than the bristle in accordance with WO 98/24341, since it is not subjected to pressure during filling.

It is particularly economical when the cavities are formed during extrusion of the filament. Therein, the cavities are preferably formed with substantially parallel axes, optionally at a separation from one another.

Another variant consists in that the cavities are formed after extrusion of the filament which would permit a substantially radial formation of cavities having arbitrary contour and arrangement.

Both above-mentioned method variants may provide that the cavities are formed as capillary gaps extending from the center of the core towards the outside or that the cavities are formed as channels with openings which narrow into a gap at the circumference. The capillary gaps produce a retaining effect for the medium and same is discharged only under conditions of use, e.g. bristle pressure, added external media, or the like.

The shape and/or width of the gaps is preferably adjusted to the consistency of the medium. It is furthermore advantageous to form the gaps such that they are completely closed in the unloaded state and open only under pressure.

In a particularly economic fashion, the cavities which open to the outside can be filled in continuous operation on an endless filament, wherein the filament is guided through an optionally pressurized medium bath or through a cross-section, tapering like a nozzle, with the medium being supplied about the circumference. If the opening width of the cavities is large enough and the consistency of the medium sufficiently viscous, filling may also be effected without pressure during continuous operation. In this case, it is advisable to subsequently close the cavities with a jacket disposed on the filament.

The jacket preferably consists of a synthetic thermoplastic material which is extruded onto the filament, filled with the medium. It is preferably extruded with excess size and shrunk onto the filament through cooling to thereby particularly protect temperature sensitive media. Liquid components can not evaporate and temperature reactant components do not decompose. If a jacket made from a plastic material permitting diffusion of the medium is applied, it may optionally be covered in parts by a diffusion-tight material to control diffusion locally and/or the diffusion rate.

If the jacket is made from transparent plastic, medium consumption can be visually monitored, e.g. through corresponding coloration of the medium. The type of media may thereby also be observed.

In addition or instead of displaying the medium and/or its consumption it is possible to provide an effectivity display for the bristle function to guarantee that the bristle is used only as long as it has the properties required for its intended use. The bristle may also be technically designed such that it is used only as long as it is effective, by applying a jacket to the filaments which is made from a thermoplastic material comprising filling agents which determine its wear factor, wherein the plastic and the added filling agents are adjusted to the admissible degree of wear of the bristle during appropriate use. This method can be used to provide any type of bristle, optionally consisting of only a core and a jacket, with an effectivity display. Filling agents which determine the wear factor can, in particular, be solids which reduce the intermolecular bonding in the polymer of the jacket and control the wear factor through their type, size and amount. The solids of an application bristle can be selected such that they simultaneously fulfill a function during application, e.g. calcium carbonate or chloride as mineral agents in tooth brushes. The addition of waxes, in particular ionomer wax, has also proved favorable since they are distributed more uniformly in the polymer matrix and thus provide a uniform wear factor. The sliding behavior of the bristle is also improved. This also permits fine adjustment of an effectivity display.

In accordance with a further method variant, for application, different media having different functions may be disposed in layers or with localized separation and can be discharged at separate locations. In the same fashion, it is possible to locally separate components of an agent, having an affinity to one another, which should be effective only at the location of use. An example thereof is the desired formation or regeneration of calcium fluoride layers on teeth which can be effected in ionising media with $Ca^{(+)}$ and $F^{(-)}$ ions which can be produced from locally separated Ca and F compounds in the moist atmosphere of the mouth and throat area.

The media or active components can also be separately disposed through layered accommodation in the cavities and combined only when dispensed. The diffusion rate of the media or active components can be controlled through the formation of layers.

Furthermore, active components and/or filling agents can be accommodated in the core or in the jacket or in both. Finally, the core may be extruded as a monofilament or multifilament. The core and/or jacket may optionally be foamed during extrusion or afterwards.

The invention finally concerns a bristle which is obtained from the filament produced in accordance with the invention through cutting to the desired length and a brush having a bristle support for mounting bristles of the above-mentioned type thereby forming a bristle field or part thereof.

In some applications, it is recommended to close the bristles at least at their useful end e.g. using thermal methods such as welding, friction welding, laser welding or the like.

The inventive method and bristles produced in accordance with the method are described below by means of some embodiments shown in the drawing.

BRIEF DESCRIPTION OF THE DRAWING

FIG. 1*a* shows a first phase of the production of a filament in cross section;

FIG. 1*b* shows a second phase of the production of a filament in cross section;

FIG. 1*c* shows a third phase of the production of a filament in cross section;

FIG. 1*d* shows a fourth phase of the production of a filament in cross section;

FIG. 1*e* shows a fifth phase of the production of a filament in cross section;

FIG. 1*f* shows a sixth phase of the production of a filament in cross section;

FIG. 2 shows a longitudinal section II—II through a filament;

FIG. 3 shows a schematic section of a brush comprising a bristle made from a filament in accordance with FIG. 2;

FIG. 4 shows a schematic representation of the medium discharge;

FIG. 12 shows a first further embodiment of a bristle core;

FIG. 13 shows a second further embodiment of a bristle core;

FIG. 14 shows a third further embodiment of a bristle core;

FIG. 15 shows a section XV—XV in accordance with FIG. 14;

FIG. 16 shows a cross-section of a first further embodiment of bristles comprising an extruded jacket;

FIG. 17 shows a cross-section of a second further embodiment of bristles comprising an extruded jacket;

FIG. 18 shows a cross-section of a third further embodiment of bristles comprising an extruded jacket;

FIG. 19 shows a cross-section of a fourth further embodiment of bristles comprising an extruded jacket;

FIG. 20 shows a cross-section of a fifth further embodiment of bristles comprising an extruded jacket;

DESCRIPTION OF THE PREFERRED EMBODIMENT

Figure 5:
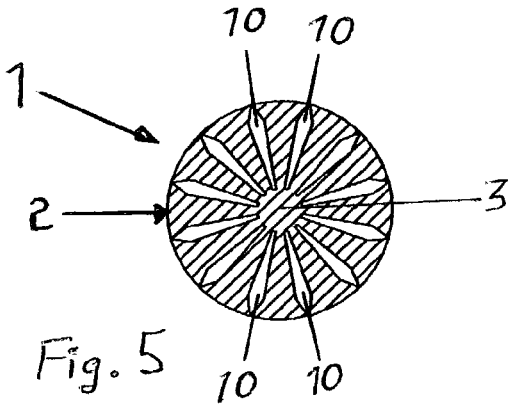
FIG. 5 shows a cross-section of a first embodiment of a bristle.

FIG. 1 shows, in illustrations a) through f), different method steps of producing a filament from which bristles are obtained by cutting to a desired length. The filament 1 is extruded in a conventional fashion from a plastic melt in the form of a core 2, which substantially determines the mechanical properties of the bristle. In the embodiment shown, the core 2 consists of a solid center 3 comprising cavities 4 starting at that location and opening towards the outside, which are obtained in this embodiment through a crossed profile of the extruded core (FIG. 1*a*). The filament is subsequently drawn in a conventional fashion (FIG. 1*b*) to obtain a longitudinal molecular orientation. The cross-section is correspondingly reduced through stretching during drawing of the core. Subsequently, the core 2 is preferably thermally stabilized (FIG. 1*c*).

The filament 1 with cavities 4, extruded and pre-treated in this fashion, is subsequently filled with the medium 6. The filament 1 is drawn through a channel (indicated in FIG. 1*d* with a circular line 5) which optionally narrows like a nozzle from a larger cross-section to the cross-section of the core 2 and into which the medium is constantly supplied such that the medium 6 is accommodated within the cavities 4 of the filament 1. The medium 6 may also be supplied under pressure, as shown in FIG. 1*e* which indicates a larger density of the medium 6. In the embodiment shown whose depressions have a very open cross-section, it is recommended to dispose a covering layer 7 onto the filament filled with the medium, which is formed like a film and which quickly wears during use of the bristle to discharge the medium 6. This covering layer 7 may also be a thin-walled jacket which consists of a diffusion-permitting polymer to allow either diffusion of the medium 6 at the location of use of the bristle or to achieve a required permeability only in connection with media at the location of use, e.g. saliva, water or the like. The jacket 7 is preferably extruded onto the previously filled filament 1 having a larger size than the core 2 and subsequently shrunk onto the core through cooling.

FIG. 2 shows the section of a bristle 8 obtained from cutting a filament produced in accordance with FIG. 1. The bristle 8 thereby consists of a core 2 comprising the medium 6 in the cavities and the jacket 7.

FIG. 3 schematically shows a section of a brush 62, e.g. in the region of a tooth brush head, comprising a bristle support 9 to which the bristles 8 are mounted. During use of the tooth brush, pressure and bending forces act on the bristle 8 leading to the schematically shown temporary deformation of the bristle 8. Due to these forces, the medium 6 is discharged at the free end of the bristle as indicated with directional markers. At the same time, if the medium has the corresponding composition, it diffuses through the walls of the jacket, optionally with the cooperation of media present at the location of use, e.g. saliva, water, tooth care means or the like. This is shown in FIG. 4 in an enlarged scale.

FIGS. 5 through 10 show cross-sections of filaments 1 which do not require separate coating or a jacket, depending on the consistency of the medium. FIG. 5 shows a filament which is extruded in the shape of a substantially circular core 2 having a solid center 3. During extrusion, cavities in the form of capillary gaps 10 are formed, which are disposed regularly and radially in the embodiment shown. The capillary gaps 10 are filled with the medium in a manner described with reference to FIG. 1.

Figure 6:
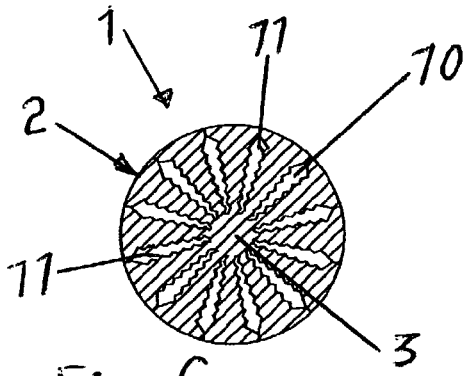
FIG. 6 shows a cross-section of a second embodiment of a bristle.

FIG. 6 shows a similar embodiment wherein the capillary gaps 10 are additionally provided with a profile 11 in the extrusion direction, thereby achieving an improved retaining capacity for the medium.

Figure 7:
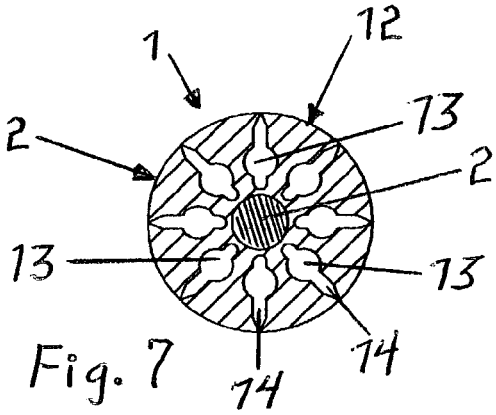
FIG. 7 shows a cross-section of a third embodiment of a bristle.
Figure 8:
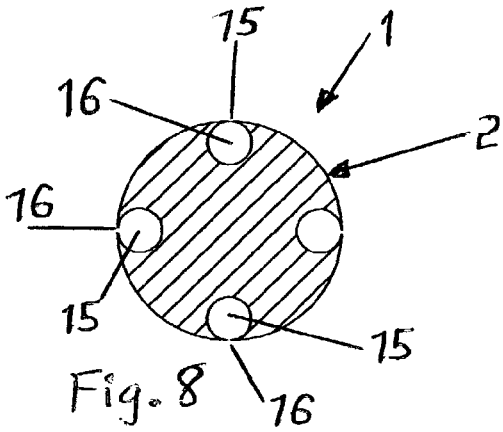
FIG. 8 shows a cross-section of a fourth embodiment of a bristle.
Figure 9:
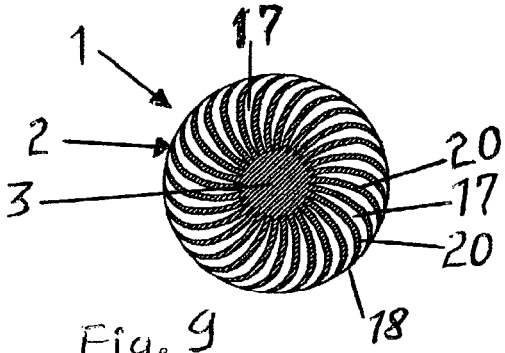
FIG. 9 shows a cross-section of a fifth embodiment of a bristle.

In the embodiment of FIG. 7, the filament 1 also consists of a solid core 2 and an external core part 12 which may be made from a different plastic material than the core 2. The core 2 is e.g. formed of a polymer providing the subsequent bristle with the required mechanical properties, while the core part 12 may consist of another polymer having properties suitable for use. The filament 1 has channel-like cavities 13 parallel to the axis of the core 2 which extend via gap-like openings 14 at the circumference of the filament 1.

FIG. 8 again shows a filament 1 in the shape of an extruded core 2 which only has a few uniformly distributed channels 15 with gap-like openings 16 proximate to the circumference.

In the embodiment in accordance with FIG. 9, the filament 1 is again extruded as core 2 having a solid center 3 from which a plurality of capillary gaps 17 extend to the outside, like shovels. The capillary gaps 17 are almost closed at the circumference 18 of the filament 1. The bridges 20, limiting the capillary gaps 17 in a shovel-like manner, can be elastically deformed to facilitate filling of the capillary gaps 17 in that the filament is turned opposite to the curvature of the shovel to open the gaps. After filling, the excessive medium is pressed out through turning in the opposite direction or by passing through a corresponding covering cross-section such that the capillary gaps 17 are almost closed at the circumference of the filament 1 or in the subsequent bristle. When brushes equipped with such bristles are used, the pressure forces effect deformation of the bristle such that the medium is discharged about the circumference.

Figure 10:
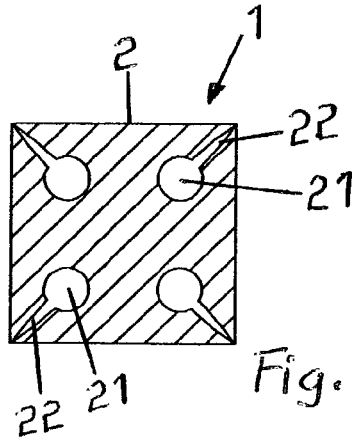
FIG. 10 shows a cross-section of a sixth embodiment of a bristle.

FIG. 10 shows a filament 1 having a rectangular cross-section into which axially parallel channels 21 are formed which open at the circumference of the filament 1 via narrow gap-like openings 22.

Figure 11:
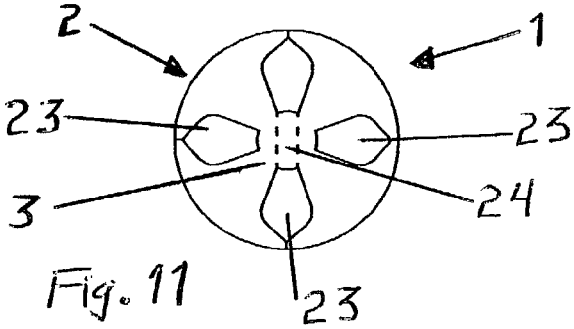
FIG. 11 shows a cross-section of a further embodiment of a bristle core.

FIG. 11 shows a filament 1 having sector-shaped cavities 23 and a central core 3 which is penetrated by the transverse channels 24. The sector-shaped cavities 23 and the transverse channels 24 are filled with the medium. This filament 1 is preferably coated with a film or provided with an extruded jacket, as described with reference to FIG. 1 through 4.

FIG. 12 shows a filament 1 in the shape of a coiled core 2, wherein the cavities 63 extend like screws. This embodiment of the filament 1 can also be easily filled with the medium, and a jacket is advantageously subsequently extruded thereon. FIG. 13 shows a filament 1 in the shape of a wavy core 2, wherein the cavities 64 are formed by wave troughs. FIG. 14 shows a filament 1 in the shape of a core 2 comprising annular cavities 65. In both embodiments, a jacket is extruded, preferably after filling of the filament 1.

FIG. 16 shows a filament 1 having an extruded core 2 of rectangular cross-section which is drawn e.g. through an annular channel, wherein the medium 6 accumulates at the side surfaces of the rectangular core 2. A jacket 7 is then extruded and optionally fixed through cooling and shrinking.

FIG. 17 represents a core 2 with uniformly distributed depressions 26 which are filled with the medium 6 in the same fashion as described above. A jacket 7 is then once more extruded onto the core 2 having the medium 6. The embodiment in accordance with FIG. 18 differs from the one shown in FIG. 17 only by the shape and number of depressions 26.

The filament of the embodiment in accordance with FIG. 19 also has the shape of a core 2 having a cross-shaped cross-section thereby forming cavities 27 which are open to the outside and filled with the medium. The core 2 has bead-like enlargements 29 at the free ends of its arms 28. After filling of the cavities 27 of the core 2, a jacket 30 is extruded to surround the bead-like enlargements thereby forming a kind of positive connection. The embodiment in accordance with FIG. 20 differs in that the arms 28 of the core 2 extend straight and that the jacket 31 is extruded and shrunk after filling of the cavities formed between the arms 28.

Figure 21:
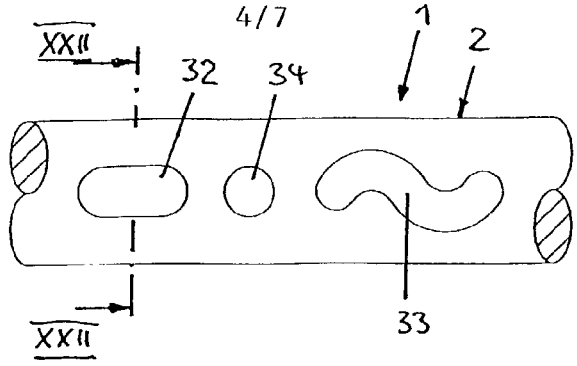
FIG. 21 shows a bristle.
Figure 22:
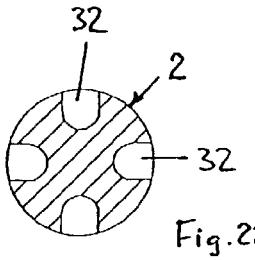
FIG. 22 shows a section XXII—XXII in accordance with FIG. 21.

FIG. 21 shows a filament 1 having the shape of a core 2, wherein different embodiments of cavities are indicated. They may be groove-like, straight depressions 32 or groove-like curved depressions 33 or individual punched depressions 34.

Figure 23:
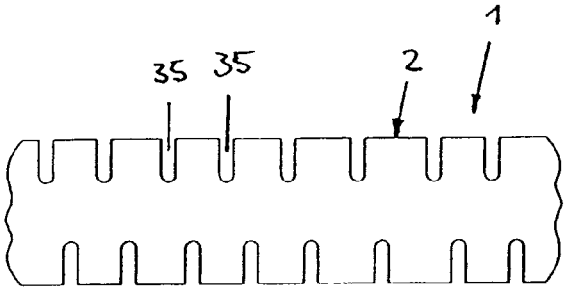
FIG. 23 shows a first further embodiment of the bristle.

In the embodiment of FIG. 23, the filament 1 has a core 2 comprising cavities in the shape of equidistantly disposed slots 35 which extend transverse to the filament axis and are formed e.g. after extrusion.

Figure 24:
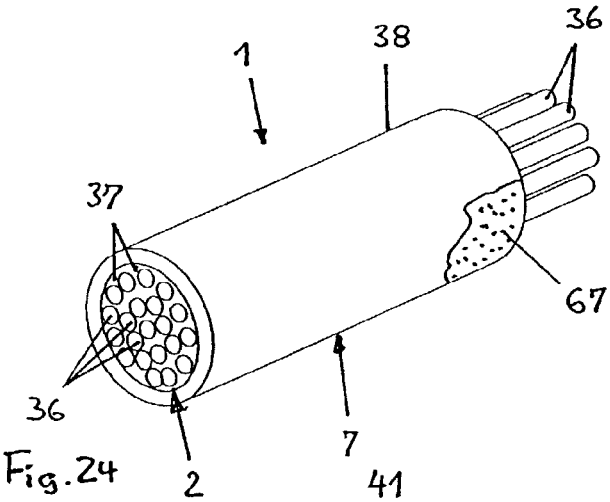
FIG. 24 shows a second further embodiment of the bristle.

FIG. 24 shows a filament 1 whose core 2 consists of a plurality of parallel monofilaments 36 wherein the cavities are formed by the gaps 37 between the monofilaments 36. After filling the gaps and optionally corresponding sizing of the monofilament strand, a jacket 38 is extruded.

FIG. 24 shows the jacket 38 partially broken away. It is provided with filling agents 65 which determine the wear behavior of the plastic and thereby the wear of the jacket.

Figure 25:
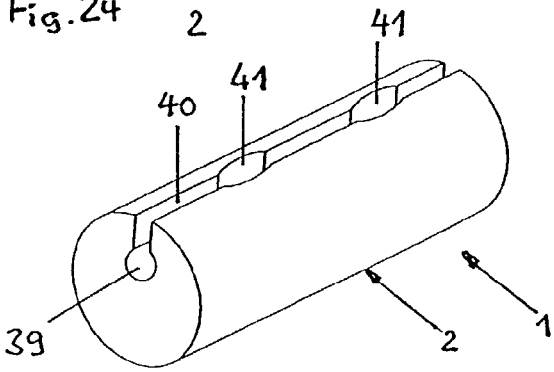
FIG. 25 shows a third further embodiment of the bristle.

FIG. 25 shows a filament 1 having the shape of a core 2 which is provided with one or more axially parallel channels 39 (similar to the embodiment of FIG. 7) which extend to the outside via gap-like openings 40. It is possible to additionally provide spaced apart openings 41 having a somewhat larger cross-section.

Figure 26:
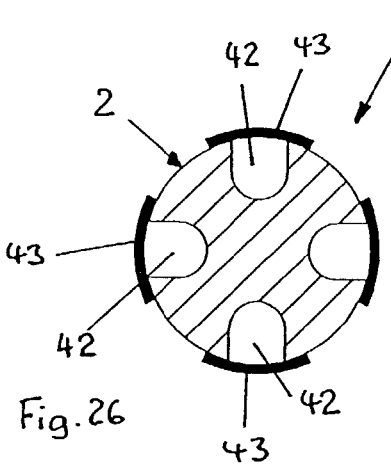
FIG. 26 shows a cross-section of a bristle with partial coating.

The embodiment of FIG. 26 shows a filament 1 also having the shape of an extruded core 2 with cavities 42 disposed at the circumference which are all covered by a subsequently disposed layer 43 which either releases the medium in the cavities 42 due to wear during use or has a permeability which permits slow diffusion of the media, optionally with cooperation of the media at the location of use.

Figure 27:
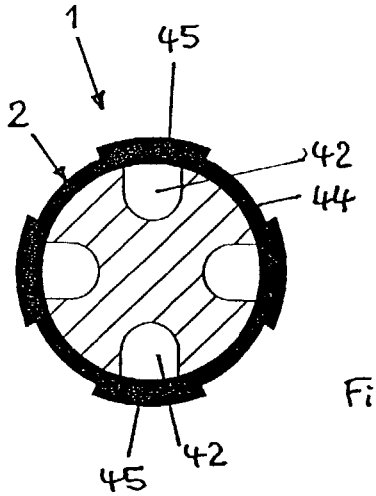
FIG. 27 shows a cross-section through a bristle comprising a jacket and partial coating.

In the embodiment of FIG. 27, the same filament as in FIG. 26 comprising a core 2 with cavities, is covered by a jacket 44 of a diffusion-permitting polymer which has e.g. the properties desired for the surface of the bristle. Additional partial coatings 45 in the region of the cavities 42 control the diffusion density and thereby discharge of the media.

Figure 28:
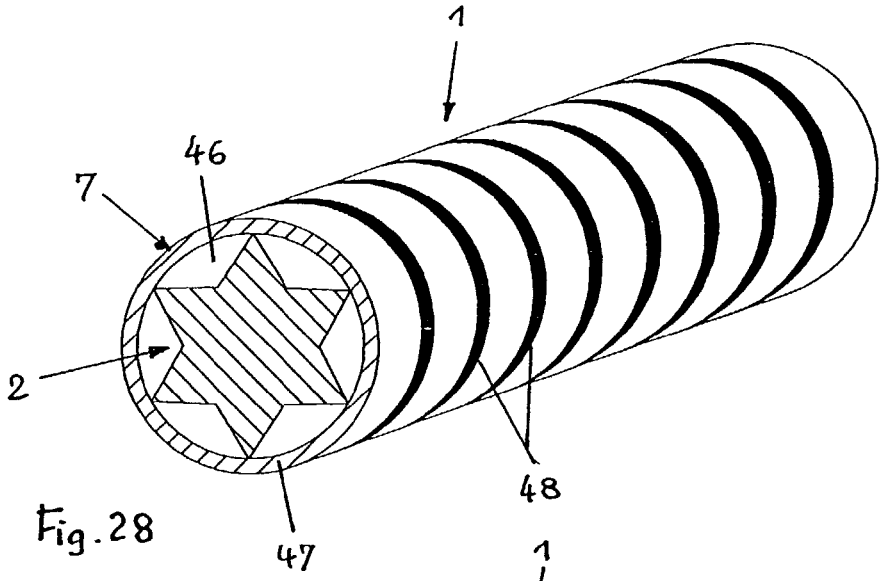
FIG. 28 shows a perspective view of a bristle comprising a jacket and additional binding.

FIG. 28 shows a filament 1 with a core having a star-shaped cross-section, wherein the cavities 46 are formed between the prongs of the star, and onto which a jacket 47 is also extruded. The jacket 47 is additionally wrapped with a plastic or textile fiber.

Figure 29:
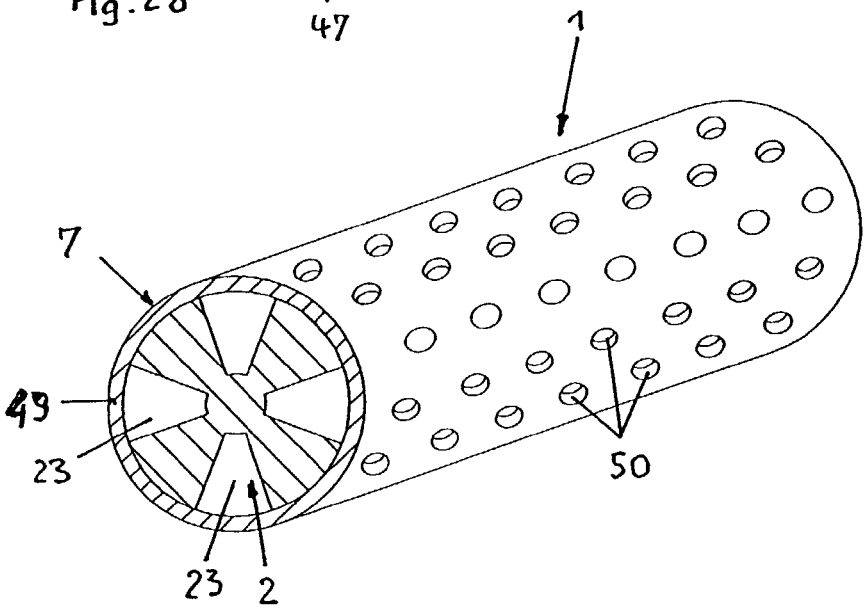
FIG. 29 shows a perspective view of a bristle with perforated jacket.

In the embodiment in accordance with FIG. 29, the filament 1 consists of a core 2 similar to the embodiment in accordance with FIG. 11, having sector-shaped cavities 23 and an extruded jacket 49 which is provided with a perforation 50 to permit controlled release of the medium and which also provides the surface of the finished bristle with a structure which increases the effect of the bristle.

Figure 30:
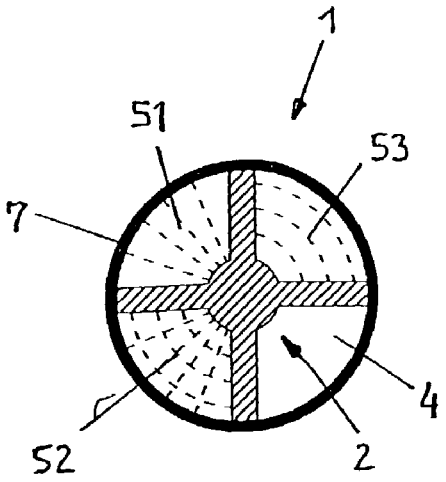
FIG. 30 shows a cross-section of a bristle comprising different media in separated cavities.

FIG. 30 shows a filament 1 having a cross-shaped core 2 and a jacket 7. Different media 51, 52 and 53 are accommodated in the cavities 4 between the core 2 and the jacket 7 which are simultaneously released and either have different effects or consist of components which become effective only at the location of use. Alternatively, differing media can also be disposed in a cavity 4, in a layered fashion.

Figure 31:
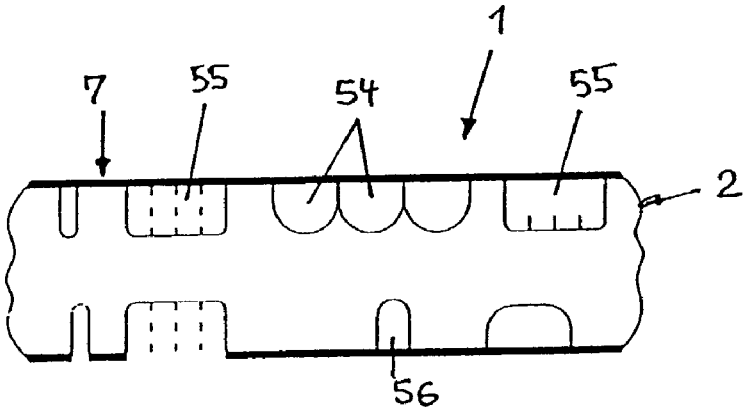
FIG. 31 shows a longitudinal section through a bristle having different cavities at the core.

The filament 1 in accordance with FIG. 31 also consists of a core 2 which has irregularly disposed cavities 54, 55 and 56 and which is surrounded by a jacket 7. These cavities can also accommodate different media, in dependence on their size and shape.

Figure 32:
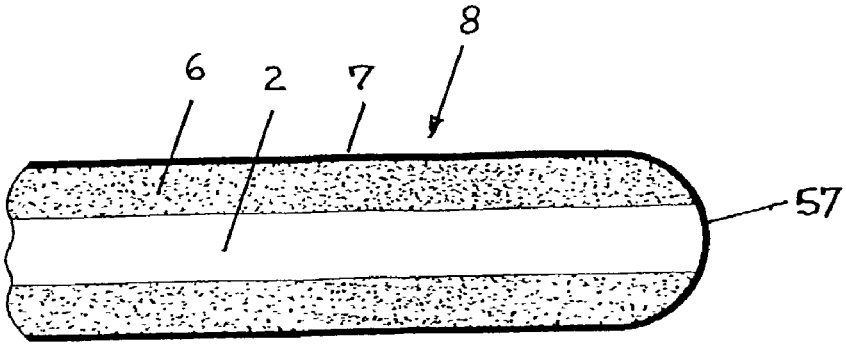
FIG. 32 shows a longitudinal section through a bristle having one closed end.

FIG. 32 shows a section of a bristle 8 with similar construction to the one according to FIG. 2, i.e. having a core 2 comprising a medium 6 located in its cavities and a jacket 7. The bristle 8 is closed at its useful end 57 e.g. by corresponding thermal formation of the jacket 8.

Figures 33, 34:
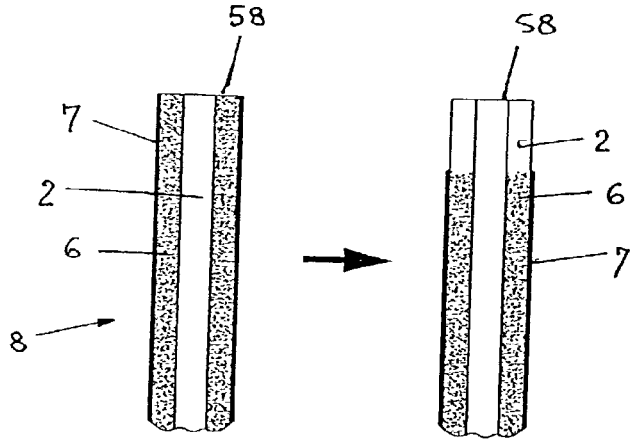
FIG. 33 shows a longitudinal section through a bristle in the initial state.
FIG. 34 shows the bristle in accordance with FIG. 33 during or after use.
Figures 35, 36, 37, 38:
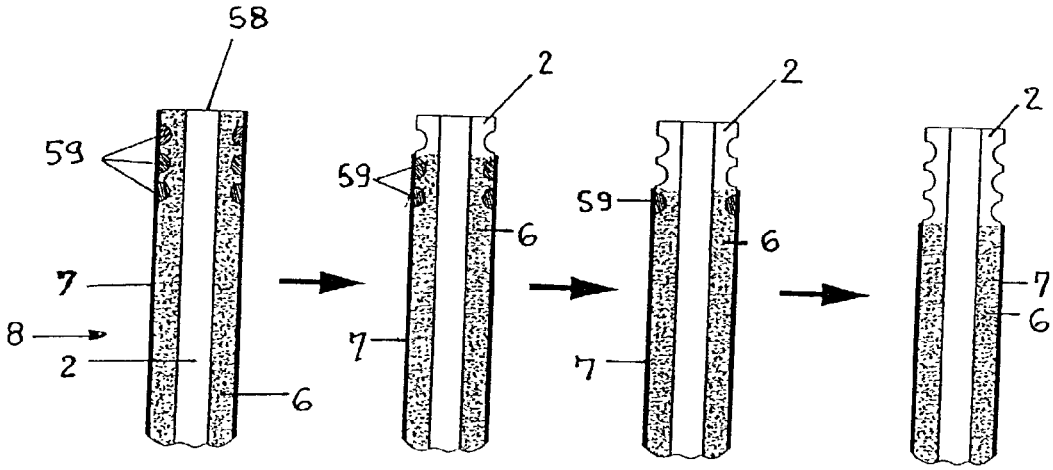
FIG. 35 shows a first longitudinal section through a bristle with effectivity display.
FIG. 36 shows a second longitudinal section through a bristle with effectivity display.
FIG. 37 shows a third longitudinal section through a bristle with effectivity display.
FIG. 38 shows a fourth longitudinal section through a bristle with effectivity display.

FIGS. 33 and 34 show an embodiment of a bristle 8 having an open end 58 in the initial state (FIG. 33) and after a certain period of use (FIG. 34) during which the jacket 8 is worn off and the medium has been released. This makes the mechanical wear and release of the medium visible.

FIG. 35 through 38 show another variant for indicating the media consumption and/or wear of the bristle. Towards this end, the core 2 optionally comprises several cavities having the shape of continuous grooves or the like which are disposed at a separation from one another and in which an indicating medium 59 is accommodated. During use, the wear of the jacket 7 starts in the region of the end 58 of the bristle 8 and only the core 2 remains. The markings 59 disappear successively such that the user is optically informed of the discharge of the medium or wear of the bristle.

Figure 39:
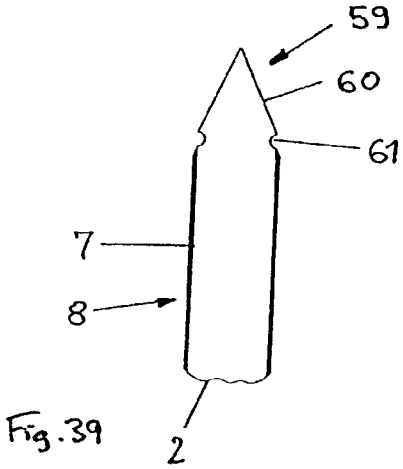
FIG. 39 shows a longitudinal section through a bristle comprising a wear display.

FIG. 39 finally shows a bristle 8 whose end 59 forms a more or less regular tip 60 during regular wear. Also in this case, the core 2 has an annular groove 61 which may optionally be filled with an indicating medium such that when same has disappeared, termination of the (optimum) period of use is signalized.

I claim:

1. A method for producing bristles for the application of a medium, the method comprising the steps of:

a) extruding a filament with a core, said core contributing to determination of mechanical properties of said filament;

b) providing said filament with cavities, said cavities formed at a separation or separations from a center of said core, each of said cavities having an opening towards an outer circumference of said filament;

c) filling said cavities with the medium via said openings; and d) fashioning bristles from said filament, wherein the medium can be discharged during appropriate use of said bristles.

2. The method of claim 1, wherein said opening comprises a gap at said outer circumference of said filament, said gap being closed in an unloaded state of the bristle, said gap first opening in response to pressure generated during proper use of the bristle to release the medium.

3. The method of claim 1, further comprising applying a layer to at least partially cover said cavities to control discharge of the medium during normal conditions of bristle use.

4. The method of claim 3, wherein said layer is disposed in the form of a jacket covering said core.

5. The method of claim 1, wherein said cavities are formed during extrusion of said core.

6. The method of claim 1, wherein said cavities are formed after extrusion of said core.

7. The method of claim 1, wherein said cavities are formed as capillary gaps.

8. The method of claim 2, wherein said cavities are formed as channels having said openings which narrow into said gaps at a circumference of said core.

9. The method of claim 2, wherein at least one of a shape and a width of said gaps is tailored to a consistency of the medium.

10. The method of claim 3, wherein said openings comprise gaps which are closed in an unloaded state of the bristle and open under pressure.

11. The method of claim 1, wherein said cavities are filled with pressurized medium via said openings.

12. The method of claim 11, further comprising guiding said filament through a volume in which the medium is kept under pressure.

13. The method of claim 1, further comprising guiding said filament through a substantially non-pressurized medium to at least partially fill said cavities.

14. The method of claim 4, wherein said jacket is applied after filling said cavities with the medium.

15. The method of claim 14, wherein said jacket is fashioned from thermoplastic material extruded onto said filament filled with the medium.

16. The method of claim 15, wherein said jacket is extruded with a larger size than said filament and is shrunk onto said filament through cooling.

17. The method of claim 14, wherein said jacket is made from a plastic material which permits diffusion of at least one of said medium and media present at a location of intended use of the bristle.

18. The method of claim 17, further comprising at least partly covering said diffusion-permitting plastic material with a diffusion-tight layer.

19. The method of claim 4, wherein said jacket is made from transparent plastic material.

20. The method of claim 1, wherein differing media are introduced into spaced apart said cavities.

21. The method of claim 20, wherein said media are introduced into separated said cavities, said media comprising a component which becomes active only through combination with at least one other component of said medium.

22. The method of claim 1, wherein said medium is introduced in layers into at least one said cavity.

23. The method of claim 22, wherein said medium comprises a plurality of components having one component which becomes active only upon combination of said components.

24. The method of claim 1, wherein an active component is directly introduced into said core.

25. The method of claim 4, wherein an active component is directly introduced into said jacket.

26. The method of claim 1, wherein a filling agent is directly introduced into said core.

27. The method of claim 4, wherein a filling agent is directly introduced into said jacket.

28. The method of claim 1, wherein said core is extruded as a multifilament.

29. The method of claim 4, wherein at least one of said core and said jacket is extruded from a directly or indirectly foamable plastic material.

30. A method for producing the bristle of claim 1, wherein a jacket member is applied onto said filament, said jacket member being made from a plastic material having filling agents which determine a wear factor thereof.

31. The method of claim 30, wherein said material and said filling agents are matched to an admissible wear factor of said bristle during appropriate use thereof.

* * * * *